US007262734B2

(12) United States Patent
Wood

(10) Patent No.: US 7,262,734 B2
(45) Date of Patent: Aug. 28, 2007

(54) APPARATUS AND METHOD FOR GENERATING A FLUID ANTENNA

(75) Inventor: James R. Wood, Grapevine, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 27 days.

(21) Appl. No.: 11/184,520

(22) Filed: Jul. 19, 2005

(65) Prior Publication Data

US 2007/0018894 A1 Jan. 25, 2007

(51) Int. Cl.
*H01Q 1/26* (2006.01)
*H01Q 13/00* (2006.01)

(52) U.S. Cl. ..... 343/701; 343/786

(58) Field of Classification Search ..... 343/701, 343/725, 786

See application file for complete search history.

(56) References Cited

U.S. PATENT DOCUMENTS 6,876,330 B2 * 4/2005 Alexeff et al. ..... 343/701
6,967,628 B2 * 11/2005 Rawnick et al. ..... 343/793
6,999,043 B1 * 2/2006 Rivera ..... 343/895

* cited by examiner

*Primary Examiner*—Shih-Chao Chen
(74) *Attorney, Agent, or Firm*—Darin C. Davis; James E. Walton

(57) ABSTRACT

A fluid antenna generator includes a first source of electrically conductive fluid and a second source of electrically conductive fluid. The first source and the second source are oriented such that, when the first source and the second source are operated, the electrically conductive fluid generated by the first source intersects the electrically conductive fluid generated by the second source. A method for generating a fluid antenna includes generating a first electrically conductive fluid portion and generating a second electrically conductive fluid portion, such that the first electrically conductive fluid portion and the second electrically conductive fluid portion intersect.

21 Claims, 8 Drawing Sheets

APPARATUS AND METHOD FOR GENERATING A FLUID ANTENNA

BACKGROUND

1. Field of the Invention

The present invention relates to an apparatus and method for generating an antenna. In particular, the present invention relates to an apparatus and method for generating a fluid antenna.

2. Description of Related Art

Electromagnetic energy can be used in many ways to sense or affect objects from a distance. Radar, for example, is reflected electromagnetic energy used to determine the velocity and location of a targeted object. It is widely used in such applications as aircraft and ship navigation, military reconnaissance, automobile speed checks, and weather observations. Electromagnetic energy may also be used to jam or otherwise interfere with radio frequency transmissions or to affect the radio transmitting equipment itself.

In certain situations, it may be desirable to radiate one or more electromagnetic pulses over an area to sense or affect objects within the area. Generally, as illustrated in FIG. 1, a signal generator 101 generates an electromagnetic pulse, which is radiated by an antenna 103 as an electromagnetic wave 105. Upon encountering an interface, such as an interface between an object 107 and a surrounding medium 109 (e.g., an atmosphere), a portion of the energy of electromagnetic wave 105 is reflected as an electromagnetic wave 111. Reflected electromagnetic wave 111 may then be received by a sensor 113, which analyzes reflected wave 111 to determine various characteristics of object 107.

It is often desirable to deploy such antennas, e.g., antenna 103, during flight. For example, a vehicle approaching an object may deploy an antenna so that electromagnetic energy may be directed toward the object. Conventional antennas generally include rigid or semi-rigid members that may be compactly folded for storage and transport and then unfolded when needed. Alternatively, conventional antennas may be wires that are explosively deployed or deployed by parachutes. A substantial amount of time is often required to deploy such antennas, which results in additional planning to determine the appropriate time to begin deployment so that the antenna will be available when needed. Further, circumstances may arise in which the immediate transmission of electromagnetic energy is desirable. If the antenna has not been deployed, there may not be sufficient time to deploy the antenna and transmit the electromagnetic energy in the desired time frame.

In other implementations, the vehicle from which the antenna is being deployed may be traveling at a very high rate of speed, for example, at a speed greater than the speed of sound. If the medium through which the vehicle is traveling has significant density, such as an atmosphere, considerable forces may act on such conventional antennas when deployed. It may, therefore, be very difficult, if not impossible, for such conventional antennas to be deployed without damage from fast-moving vehicles.

It is also be desirable in certain situations to transmit electromagnetic energy having a broad spectrum of frequencies or to transmit low frequency electromagnetic energy. Generally, longer antennas are capable of transmitting electromagnetic energy more efficiently at lower frequencies than shorter antennas. Such longer antennas are typically capable of transmitting electromagnetic energy having higher frequencies as well. Longer, foldable antennas require more storage space, are typically more complex, generally take longer to unfold, and are typically more susceptible to damage upon deployment.

While there are many deployable antennas well known in the art, considerable room for improvement remains.

SUMMARY OF THE INVENTION

In one aspect, the present invention provides a fluid antenna generator. The fluid antenna generator includes a first source of electrically conductive fluid and a second source of electrically conductive fluid. The first source and the second source are oriented such that, when the first source and the second source are operated, the electrically conductive fluid generated by the first source intersects the electrically conductive fluid generated by the second source.

In another aspect of the present invention, an alternative embodiment of a fluid antenna generator is provided. The fluid antenna generator includes a first plurality of sources of electrically conductive fluid, oriented such that the electrically conductive fluid generated by each of the first plurality of sources intersects. The fluid antenna generator further includes a second plurality of sources of electrically conductive fluid, oriented such that the electrically conductive fluid generated by each of the second plurality of sources intersects. The second plurality of sources of electrically conductive fluid is also oriented such that the electrically conductive fluid generated by the second plurality of sources intersects the electrically conductive fluid generated by the first plurality of sources.

In yet another aspect of the present invention, a method for generating a fluid antenna is provided. The method includes generating a first electrically conductive fluid portion and generating a second electrically conductive fluid portion, such that the first electrically conductive fluid portion and the second electrically conductive fluid portion intersect.

The present invention provides significant advantages, including: (1) the ability to quickly deploy the antenna during flight without damage to the antenna and (2) the ability to transmit broad-spectrum electromagnetic energy over the antenna.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
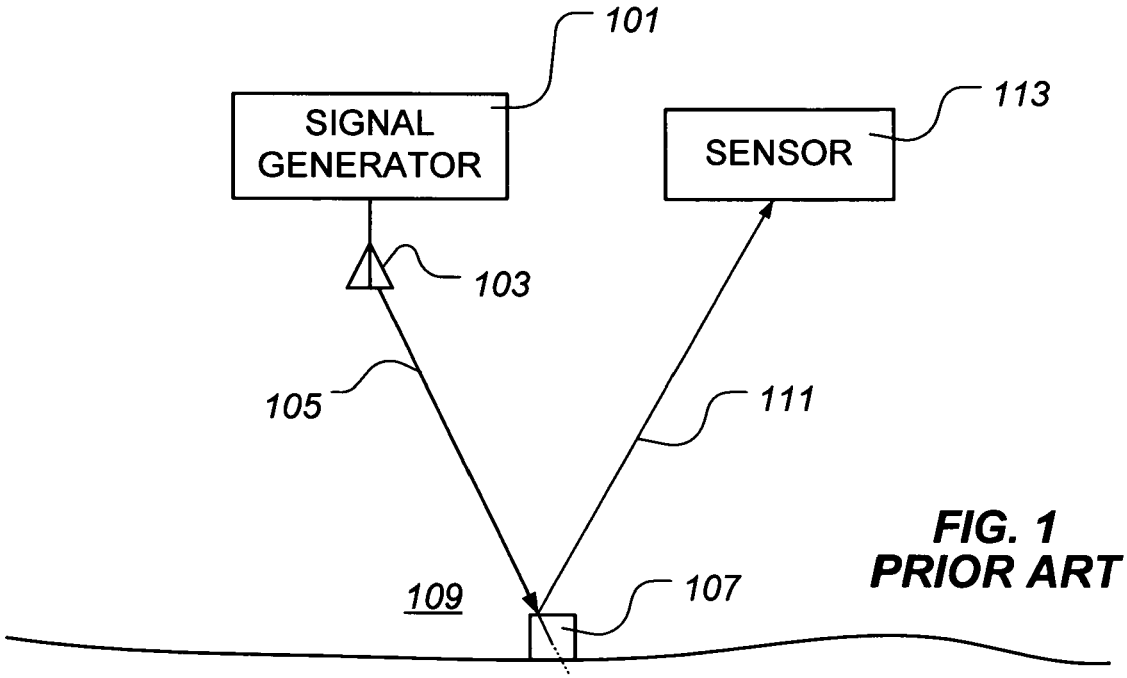
FIG. 1 PRIOR ART
FIG. 1 is a graphical representation of the radiation and reception of an electromagnetic signal, as is conventionally known.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus and method for generating a fluid antenna. In particular, an antenna generated by the present invention includes two or more intersecting fluid portions to form the antenna. Each of the fluid portions is generated by explosively propelling a material at a high velocity. In one embodiment, the material is explosively propelled, generating a secondary reaction in the material that sufficiently heats an ionizable material to a temperature at or above its ionization temperature, thus generating a plasma. In another embodiment, an electrically conductive material is explosively propelled with sufficient kinetic energy to form the material into a superplastic fluid portion, such as a metal or ceramic jet.

Generally, a fluid is any substance that is able to flow. Any liquid, gas, or plasma, therefore, is a fluid. Further, materials in a state of superplasticity are able to flow because the materials have an extremely low resistance to deformation. Thus, for the purposes of the present application, the term "fluid" means any liquid, gas, plasma, or material in a state of superplasticity. Various embodiments of "fluid" antenna generators for producing fluid antennas are described below and shown in FIGS. 2-17. In these embodiments, the fluid is electrically conductive. While particular embodiments may include plasma antenna generators for producing plasma antennas or jet antenna generators for producing jet antennas, all of the embodiments presented herein and shown in the drawings are fluid antenna generators for producing fluid antennas.

In this Specification, reference may be made to the directions at which certain materials are propelled and to the direction of fluid, plasma, or jet generation, as depicted in the attached drawings. However, as will be recognized by those skilled in the art after a complete reading of the present application, the device and systems described herein may be positioned in any desired orientation. Thus, the reference to a particular direction should be understood to represent a relative direction and not an absolute direction. Similarly, the use of terms such as "above", "below", or other like terms to describe a spatial relationship between various components should be understood to describe a relative relationship between the components as depicted in the drawings, as the device described herein may be oriented in any desired direction.

Figure 2:
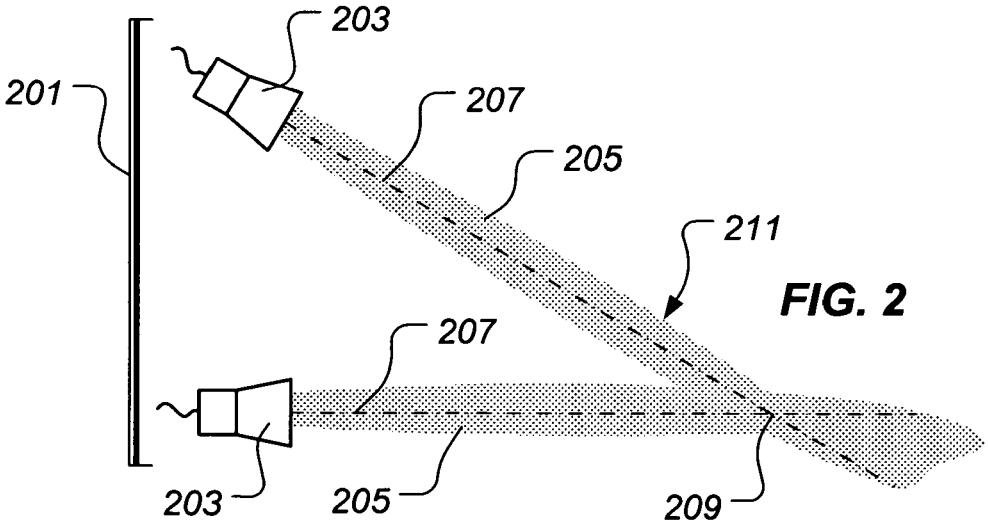
FIG. 2 is a side, elevational view of an illustrative embodiment of a plasma antenna generator according to the present invention.

FIG. 2 depicts a side, elevational view of a first illustrative embodiment of a plasma antenna generator 201 according to the present invention. In the illustrated embodiment, plasma antenna generator 201 comprises two plasma sources 203 that are each adapted to generate generally columnar plasmas 205 extending along axes 207 extending from plasma sources 203. Note that columnar plasmas 205 need not be cylindrical in form. Plasma sources 203 are oriented such that plasmas 205 emitted from plasma sources 203 intersect, generally at 209. Intersected plasmas 205 form a plasma antenna 211.

Generally, plasma sources 203 include an explosive material that, when detonated, propels an ionizable material and imparts heat to the ionizable material sufficient to achieve at least the ionizing temperature of the ionizable material. As particles of the ionizable material are ionized, plasma trails are produced comprising ions and free electrons. The plasma trails, in the aggregate, form plasma 205. The free electrons act as an antenna that is capable of reflecting electromagnetic energy having frequencies below the cut-off frequency of plasma 205. Electromagnetic energy having frequencies above the cut-off frequency of plasma 205 generally propagates through plasma 205. The plasma cut-off frequency of plasma 205 is generally proportional to the square root of the electron density of plasma 205.

Figure 3:
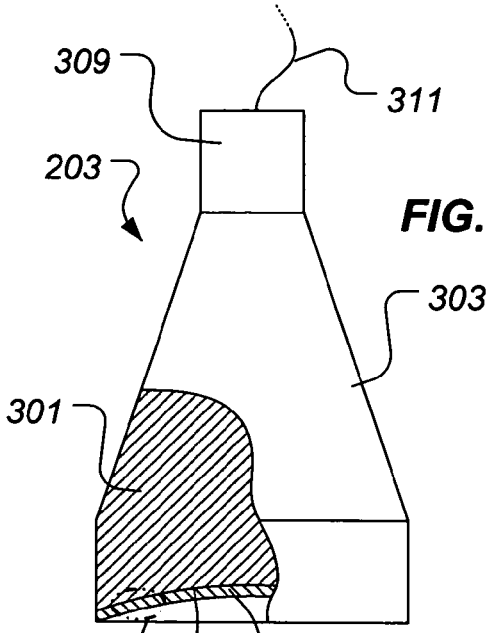
FIG. 3 is a side, elevational view of an illustrative embodiment of a columnar plasma source according to present invention.

FIG. 3 depicts one particular embodiment of plasma source 203. In the illustrated embodiment, plasma source 203 is implemented as a "shaped charge", which includes an explosive that has been shaped in such a way that, when detonated, the energy of the detonated explosive is channeled in one general direction. In the illustrated embodiment, plasma source 203 includes an explosive charge 301 disposed in a housing 303. A liner 305 comprising an ionizable material is disposed on or proximate a forward face 307 of explosive charge 301. Note that forward face 307 of explosive charge 301 and liner 305 may take on any shape suitable for a shaped charge. Examples of such shapes include, but are not limited to, conical, hemispherical (shown in FIG. 3), trumpet-shaped, bi-conic, and the like. Explosive charge 301 is detonated by detonator 309. Detonator 309 may be initiated by an electrical signal transmitted through lead 311 or by other initiation means.

Explosive charge 301 may comprise any explosive material capable of propelling the ionizable material and imparting sufficient energy to the ionizable material to ionize the ionizable material. High detonation velocity explosives are well suited for explosive charge 301. Generally, a high detonation velocity explosive is characterized as an explosive material having a detonation velocity of at least about 6000 meters per second. Examples of high detonation velocity explosive materials include, but are not limited to, cyclotetramethylenetetranitramine (HMX), HMX blended with another explosive material (i.e., an "HMX blend"), cyclotrimethylenetrinitramine (RDX), RDX blended with another explosive material (i.e., an "RDX blend"), an HMX/estane blend (e.g., LX-14), or the like.

Figure 4:
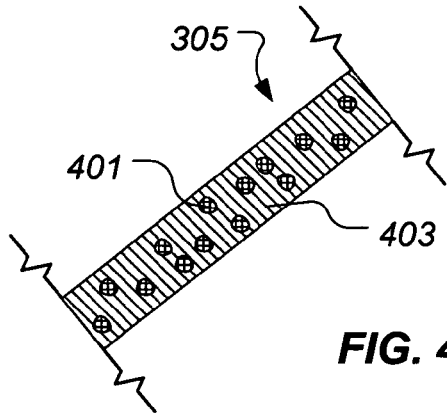
FIGS. 4-6 are cross-sectional views of various alternative, illustrative embodiments of a liner of the plasma source of FIG. 3.
Figure 5:
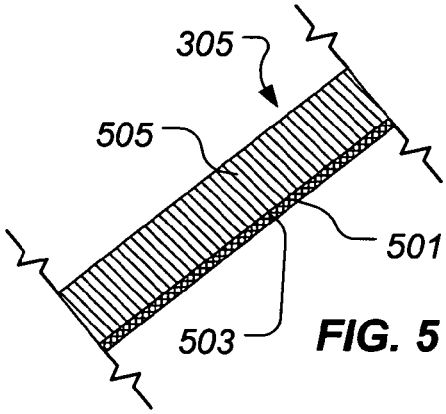
Figure 6:
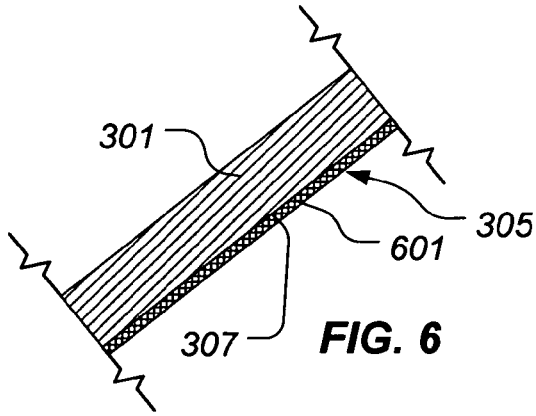

As discussed above, liner 305 includes an ionizable material. Liner 305 may also include other materials, such as copper, a copper alloy, a ceramic, or other material suitable for shaped charge liners. FIGS. 4-6 illustrate, in cross-section, three particular embodiments of liner 305 according to the present invention. FIG. 4 illustrates an embodiment wherein particles 401 (only one indicated for clarity) of ionizable material are disposed in a matrix 403 of copper, a copper alloy, a ceramic, or other suitable shaped charge liner material. Note that the present invention is not limited to the particular size of particles 401 illustrated in FIG. 4. Rather, particles 401 may be of any suitable size, including sizes that are not visible to the naked eye.

Liner 305 may alternatively comprise a coruscative compound, which are compounds that, when explosively compressed, detonate and form solid detonation products without gas detonation products. This reaction, which is also known as a "heat reaction", can liberate several times the amount of energy density of the explosive that initiates the coruscative detonation. Coruscative compounds include, but are not limited to, carbon powder with titanium powder, carbon powder with zirconium powder, carbon powder with hafnium powder, tantalum powder with carbon powder, and the like. Note that the carbon powder in the exemplary compounds provided above may be replaced with boron powder. In one such example, liner 305 may comprise tantalum powder with boron powder, resulting in a lighter weight liner 305 with similar energy released at detonation, as compared to liner 305 comprising tantalum powder with carbon powder.

FIG. 5 provides an alternative, illustrative embodiment of liner 305, wherein the ionizable material is disposed as a layer 501 on a forward or outer face 503 of a substrate 505. Substrate 505 may comprise copper, a copper alloy, or other suitable shaped charge liner material. In one embodiment, layer 501 of ionizable material comprises a layer of particulate ionizable material.

FIG. 6 provides another illustrative, alternative embodiment of liner 305 according to the present invention. In this embodiment, a layer 601 of ionizable material is disposed directly on forward face 307 of explosive charge 301. It should be noted that the ionizable material may be incorporated into plasma source 203 in any suitable fashion, such that explosive charge 301, when detonated, propels the ionizable material and imparts heat energy into the ionizable material to ionize the ionizable material or initiate a secondary reaction in the liner to locally heat, and thus ionize, the ionizable material.

The ionizable material may comprise any material capable of being ionized as a result of heating induced by being propelled by explosive charge 301 when detonated. For example, the ionizable material may comprise one or more alkali metals; may comprise a compound of one or more alkali metals, such as alkali salts, alkali carbonates, and the like; or may be a constituent of a compound of one or more alkali metals. Alkali metals include lithium, sodium, potassium, rubidium, cesium, and francium. Further, the ionizable material may be mechanically combined with another material. For example, the ionizable material may comprise particulates within another material or may comprise a layer affixed to another material, as discussed above concerning FIGS. 4 and 5. The ionizable material may be a component of a clathrate, in which particles of the ionizable material are trapped within the crystal lattice of another material. The ionizable material may be a component of an intercalation compound, wherein particles of the ionizable material are trapped between layers of another material's crystal lattice. These forms of the ionizable material, however, are merely exemplary and are not exclusive. The ionizable material may take on any suitable form, such that explosive charge 301, when detonated, propels the ionizable material and imparts energy sufficient to heat, and thus ionize, the ionizable material. Alternatively, the detonation of the explosive charge 301 can propel liner 305 and the ionizable material, initiating a secondary reaction in the liner 305 material, which locally heats and ionizes the ionizable material.

Figure 7:
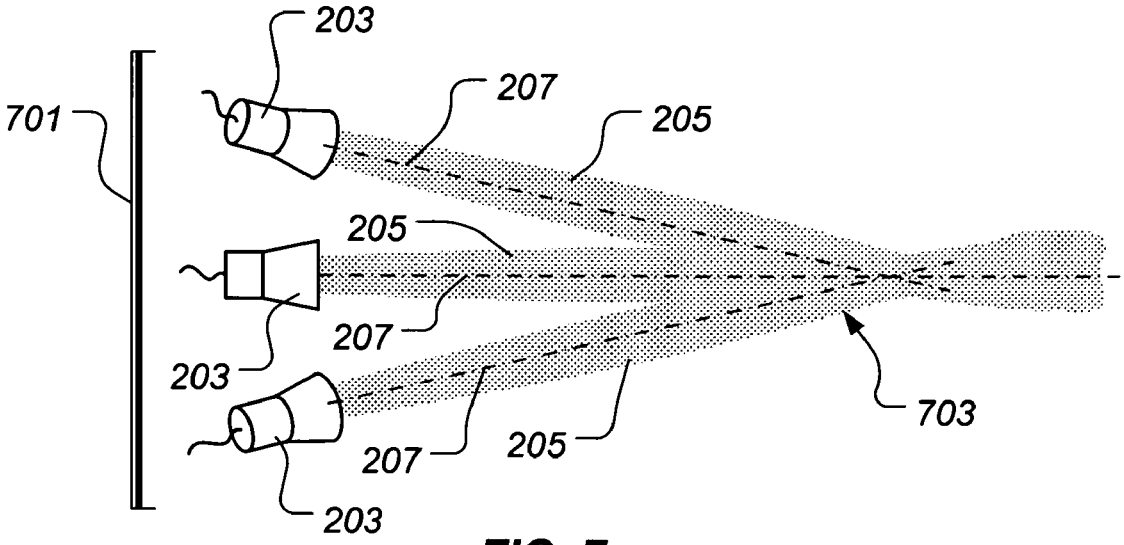
FIG. 7 is a top, plan view of an illustrative embodiment of a plasma antenna generator according to the present invention.

It should be noted that, in various embodiments, the plasma antenna generator of the present invention may include any suitable number of a plurality of plasma sources. For example, as shown in FIG. 7, plasma antenna generator 701 includes three plasma sources 203. The plasma sources 203 are oriented such that their plasmas intersect, forming a plasma antenna 703.

Figure 8:
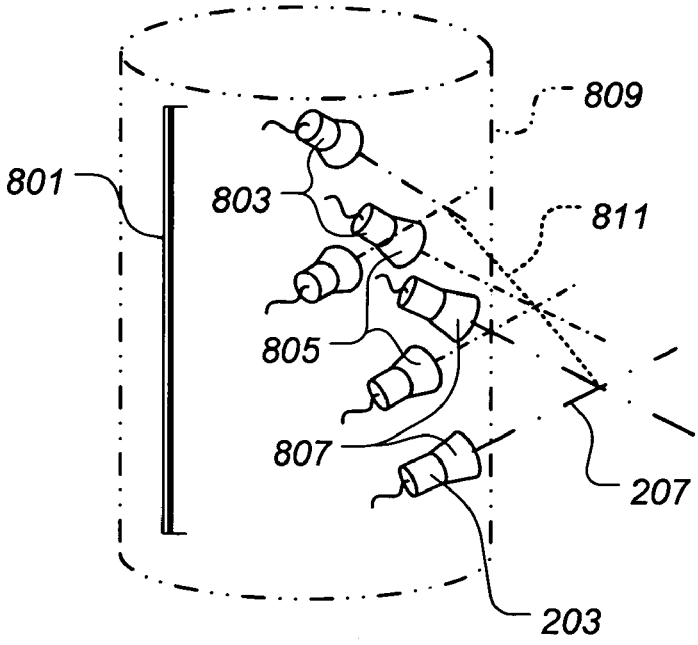
FIG. 8 is a perspective view of an illustrative embodiment of a plasma antenna generator according to the present invention.

FIG. 8 illustrates one particular embodiment of a plasma antenna generator 801 comprising three pairs 803, 805, 807 of plasma sources 203. The plasmas generated upon detonation of the pairs of plasma sources 203, however, extend along axes 207 and intersect, as discussed above. Note that only one plasma source 203 and one axis 207 is labeled in FIG. 8 and that the plasmas generated by plasma sources 203 are not shown in FIG. 8 to improve clarity. Moreover, plasmas from adjacent pairs of plasma sources 203 may overlap. For example, plasmas generated by pair 803 of plasma sources 203 may overlap plasmas generated by pair 805 of plasma sources 203.

In the illustrated embodiment, pairs 803, 805, 807 of plasma sources 203 (only one labeled for clarity) are disposed within and are oriented with respect to one another by a body 809, shown in phantom. The detonation of each pair 803, 805, 807 may be timed to generate a shaped plasma antenna. For example, as illustrated in FIG. 8, pairs 803, 805, 807 may be sequentially detonated to produce a generally helical plasma antenna, progressing along a line 811 defined generally by the intersections of axes 207 of each pair 803, 805, 807 and, thus, defined generally by the intersections of the plasmas generated by plasma sources 203. The scope of the present invention, however, is not limited to the particular configuration shown in FIG. 8 or to a helically-shaped plasma antenna. Rather, pairs 803, 805, 807 and, indeed, each plasma source 203 may be oriented depending upon the implementation to produce a plasma antenna of the desired shape. Note that the embodiment of FIG. 8 may include many more pairs (e.g., pairs 803, 805, 807) of plasma sources 203 that, in the aggregate, can produce a multi-turn, helical plasma antenna or a plasma antenna of another desired shape.

Figure 9:
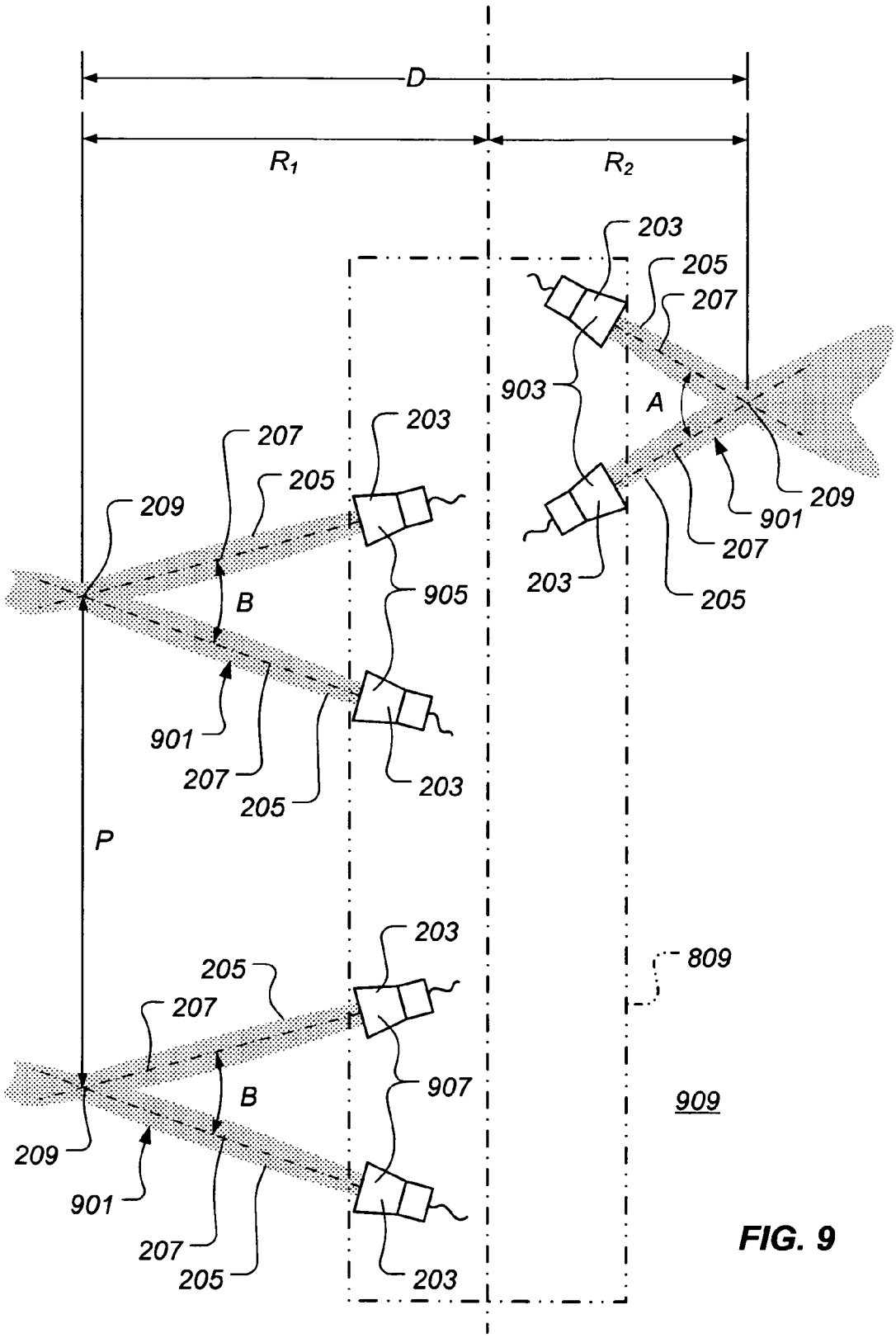
FIG. 9 is a graphical representation of how various factors affect the characteristics of a plasma antenna generated by the present invention.

Referring now to FIG. 9, various factors affect the characteristics of a plasma antenna generated by the present invention. While the configuration shown in FIG. 9 may represent an embodiment for a particular implementation of the present invention, the configuration of FIG. 9 is provided to illustrate various design aspects of the present invention. For the purposes of this discussion, a diameter D of plasma antenna 901 is the distance between intersections of opposing plasmas. In this particular example, diameter D is made up of radii $R_1$, $R_2$. Diameter D is affected by the angle defined by intersecting axes 207 extending normally in a forward direction from plasma sources 203. Generally, greater angles defined by intersecting axes 207 result in longer radii $R_1$, $R_2$. Conversely, smaller angles defined by intersecting axes 207 result in shorter radii $R_1$, $R_2$. For example, as shown in FIG. 9, angle A defined by axes 207 extending from pair 903 of plasma sources 203 is greater than angle B defined by axes 207 extending from pairs 905, 907 of plasma sources 203. Accordingly, radius $R_1$ is greater than radius $R_2$.

A pitch P is a distance between intersections of plasmas generated by adjacent pairs of plasma sources 203. Pitch P is affected primarily by the time delay between the detonation of adjacent pairs of plasma sources 203 and velocity V of the adjacent pairs of plasma sources 203 as they move through a medium 909. In general, a greater time delay between the detonation of adjacent pairs of plasma sources 203 and a greater velocity V result in a greater pitch P. Conversely, a shorter time delay between the detonation of adjacent pairs of plasma sources 203 and a shorter velocity V result in a smaller pitch P. For example, if the velocity V is 1100 meters per second and the time delay is three milliseconds, the resulting pitch P is about three meters. It should be noted that various time delays and/or velocities V may, in combination, provide the same pitch P.

Figure 10:
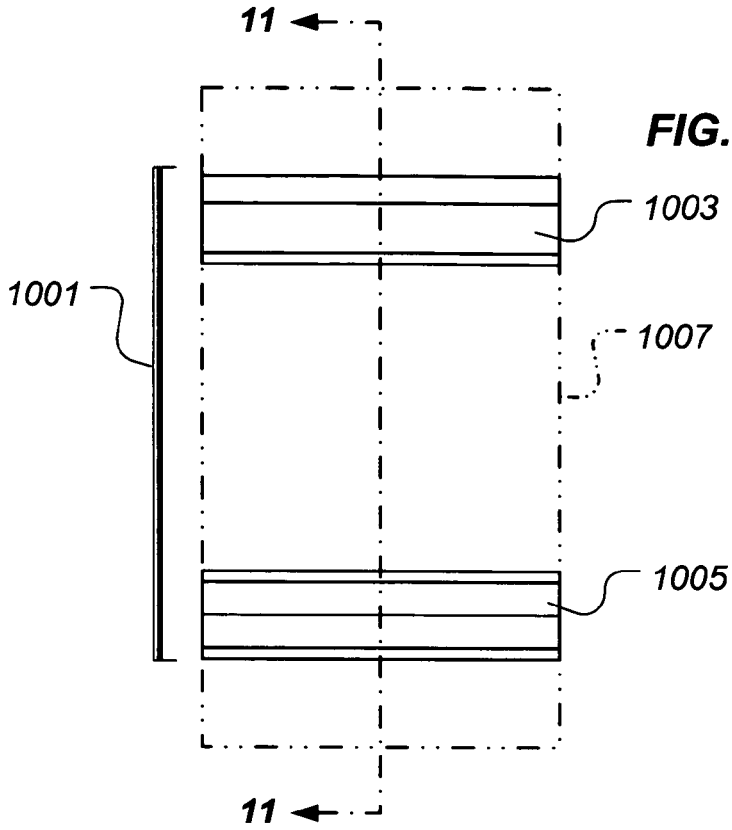
FIG. 10 is a side, elevational view of an illustrative embodiment of a plasma antenna generator according to the present invention.

Referring now to FIG. 10, a plasma antenna generator 1001 according to the present invention may include a plurality of sheet plasma sources 1003, 1005 as an alternative to plasma sources 203. In the illustrated embodiment, plasma sources 1003, 1005 are mounted in a body 1007. Note that the term "sheet", as it is used herein, means a planar or non-planar sheet. Plasma antenna generator 1001 may be operated in the same way discussed above concerning plasma antenna generator 201; however, plasma antenna generator 1001 generates a sheet-like plasma rather than a generally columnar plasma.

Figure 11:
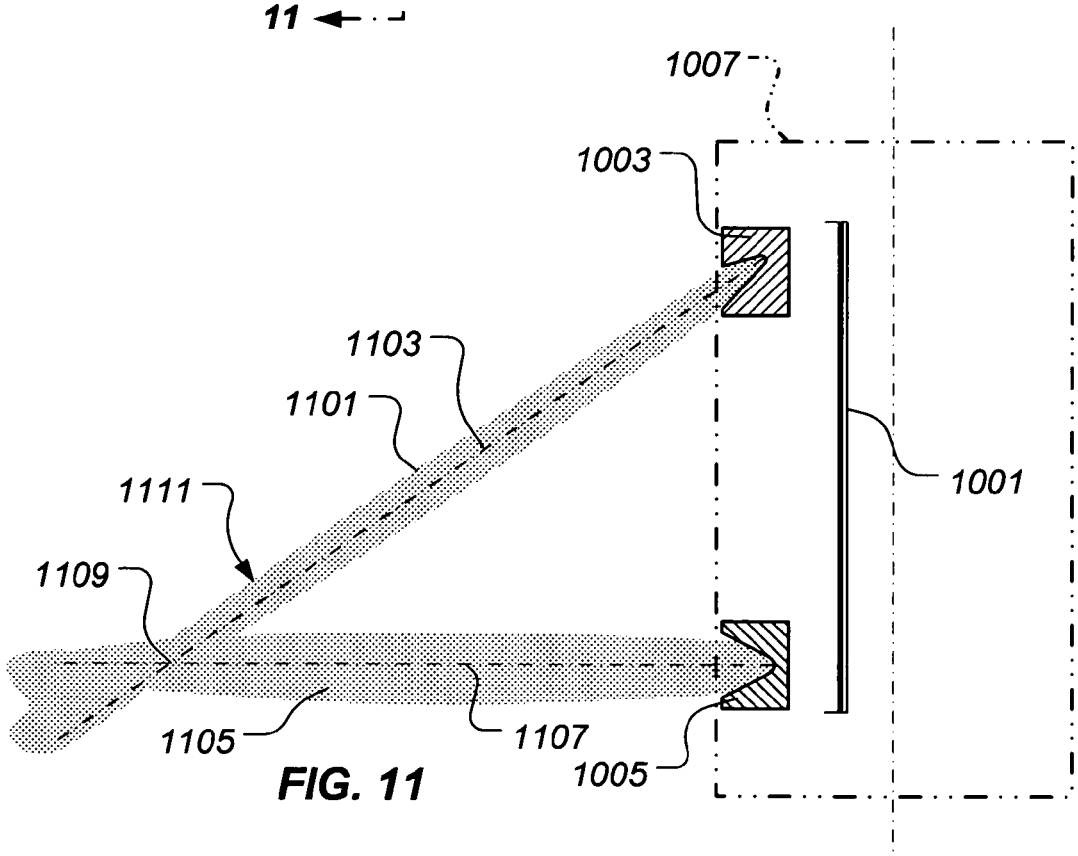
FIG. 11 is a cross-sectional view of the plasma antenna generator embodiment of FIG. 10 taken along the line 11-11 in FIG. 10.

FIG. 11 depicts plasma antenna generator 1001 in cross-section. In the illustrated embodiment, each of plasma sources 1003, 1005 comprises a "line charge", as will be discussed in greater detail below, and extends partially around body 1007, as is more clearly shown in FIG. 15. Note that for the purposes of this disclosure, the term "line charge" means a charge extending along a straight or curved path, as will be more fully discussed below.

Still referring to FIG. 11, plasma source 1003 generates a plasma 1101 generally extending along surface 1103. Plasma source 1005 generates a plasma 1105 generally extending along surface 1107. In this context, the term "surface" means "a planar or curved two-dimensional locus of points." Plasmas 1101, 1105 intersect generally at 1109, forming a plasma antenna 1111. In this particular embodiment, plasma source 1003 is configured to generate plasma 1101 downwardly, as illustrated in FIG. 11, toward plasma 1105.

Figure 12:
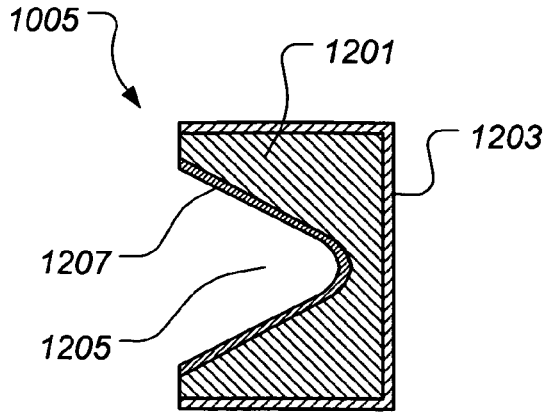
FIG. 12 is a cross-sectional view of an illustrative embodiment of a sheet plasma source according to the present invention.

FIG. 12 illustrates one particular construction of plasma source 1005 in cross-section. In this embodiment, plasma source 1005 comprises a linear shaped charge. Note that, in this context, the term "linear shaped charge" includes linear shaped charges that have straight or curved forms and may be flexible or rigid. Plasma source 1005 includes an explosive charge 1201 disposed in a housing 1203. Explosive charge 1201 defines a groove 1205. Moreover, explosive charge 1201 may comprise any suitable explosive material, such as the materials discussed above concerning explosive charge 301 (shown in FIG. 3). A liner 1207 is disposed in groove 1205. Liner 1207 comprises an ionizable material, as discussed above concerning liner 305 (shown in FIG. 3). Liner 1207 may, in various embodiments, have a construction corresponding to the constructions of FIGS. 4-6.

Figure 13:
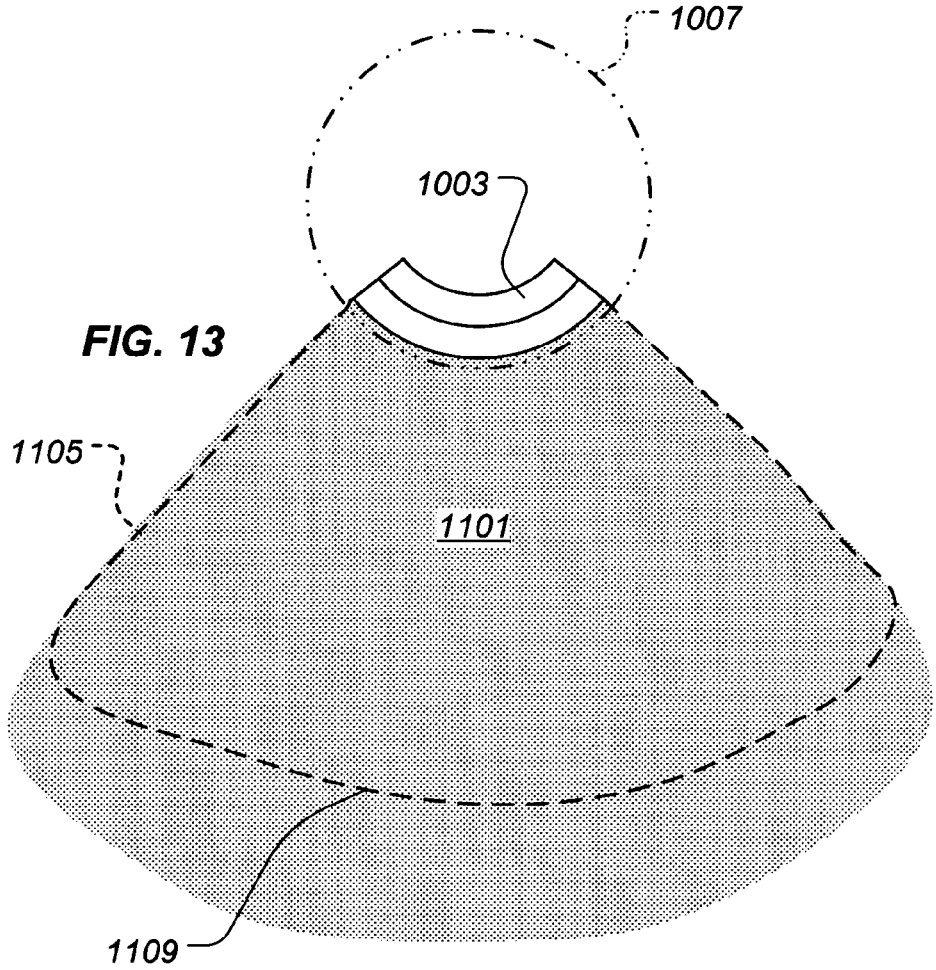
FIG. 13 is a top, plan view of the plasma antenna generator embodiment of FIG. 10.

As depicted in FIG. 13, the plasma antenna generator 1001 generates sheet-like plasmas 1101, 1105 that intersect along a boundary, generally at 1109. In this view, plasma 1105 is generally covered by plasma 1101 and, thus, a boundary of plasma 1105 is represented by a hidden line.

Figure 14:
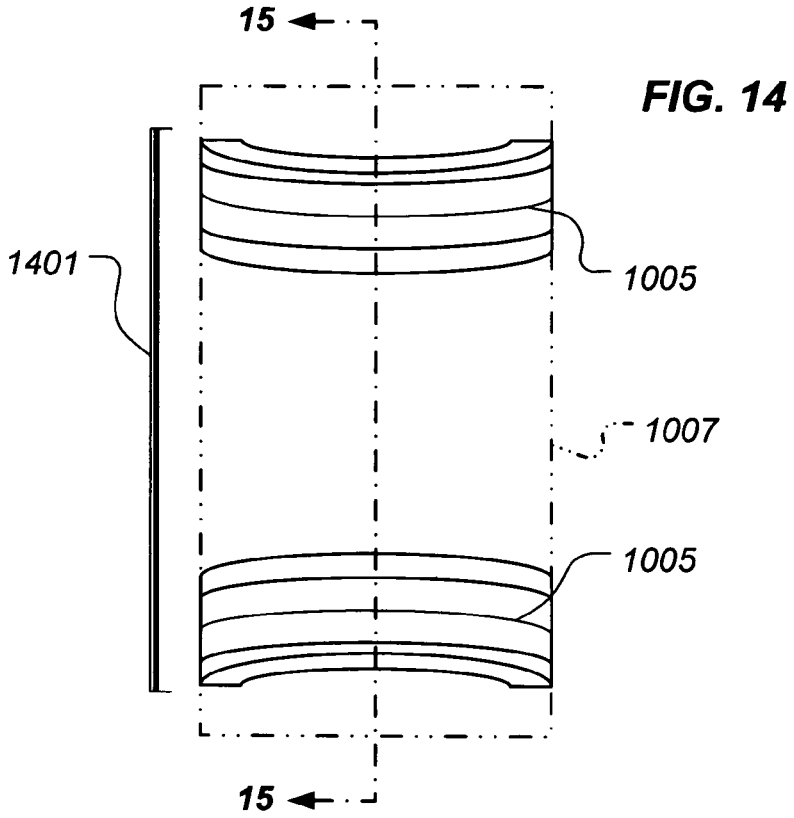
FIG. 14 is a side, elevational view of an illustrative embodiment of a plasma antenna generator according to the present invention.
Figure 15:
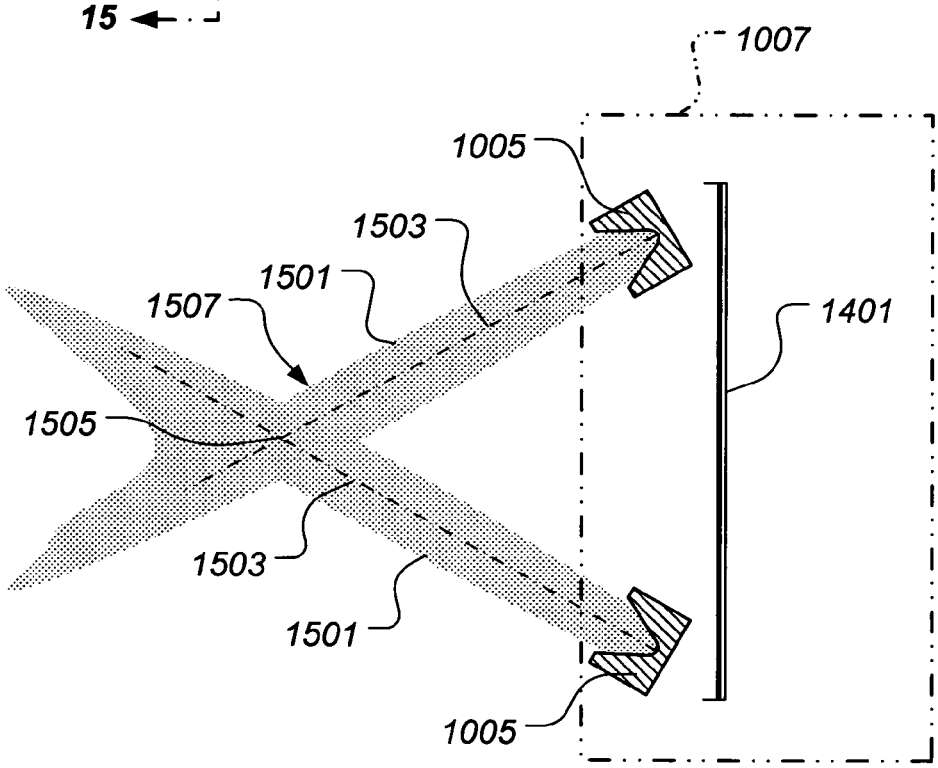
FIG. 15 is a cross-sectional view of the plasma antenna generator embodiment of FIG. 14 taken along the line 15-15 in FIG. 14.

FIGS. 14 and 15 depict an illustrative embodiment of a plasma antenna generator 1401 according to the present invention alternative to the embodiment of FIGS. 10 and 11. In this embodiment, two plasma sources 1005 are canted within body 1007, such that plasmas 1501 generated upon detonation of plasma sources 1005 extend along surfaces 1503 and intersect, generally at 1505, to form plasma antenna 1507. In other aspects, plasma antenna generator 1401 generally corresponds to plasma antenna generator 1001 of FIGS. 10 and 11.

It should be noted that the scope of the present invention encompasses one or more generally columnar plasma sources 203 in combination with one or more sheet plasma sources 1003, 1005. Moreover, the scope of the present invention encompasses plasma sources that generate plasmas having shapes other than generally columnar and sheet-like. It should also be noted that, in some embodiments of the present invention, generally columnar plasma sources 203 may be configured to produce an angularly-oriented plasma without rotating plasma source 203, in the same way that sheet plasma source 1003 generates an angularly-oriented plasma (see FIG. 11).

Figure 16:
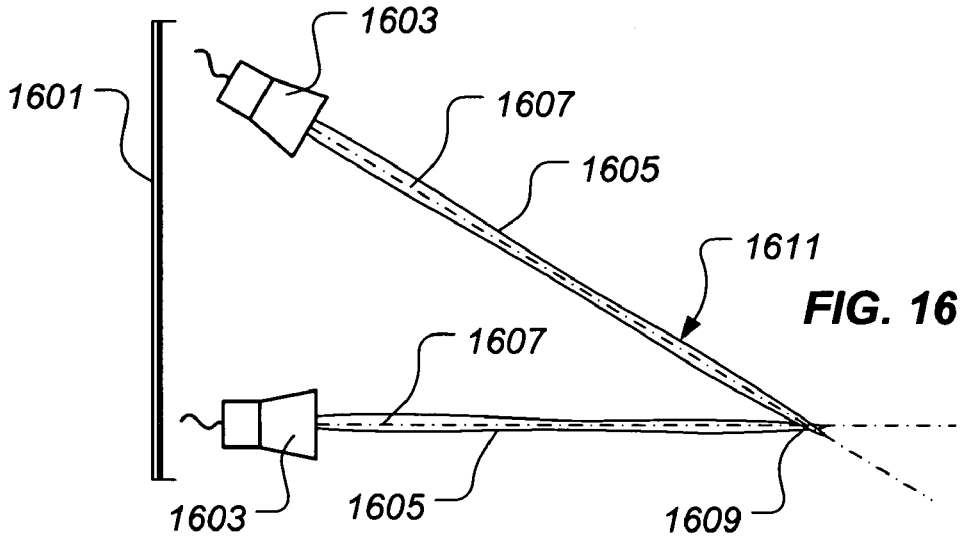
FIG. 16 is a side, elevational view of an illustrative embodiment of a jet antenna generator according to the present invention.

As discussed above, a plasma antenna is but one type of fluid antenna. Another type of fluid antenna, according to the present invention, is a jet antenna, such as a metallic jet antenna. FIG. 16 depicts one particular embodiment of a jet antenna generator 1601 according to the present invention. This embodiment generally corresponds to the embodiment of FIG. 2, except that a jet source 1603 generates a jet instead of a plasma, as does plasma source 203. In one embodiment, jet source 1603 generally corresponds to the embodiment of plasma source 203 shown in FIG. 3, except that liner 305 comprises an electrically conductive material, such as a metal. When explosive charge 301 is detonated, the ensuing detonation wave collapses liner 305 into a very high speed jet 1605 projected along axis 1607. Jets 1605 intersect generally at 1609 to form jet antenna 1611.

Figure 17:
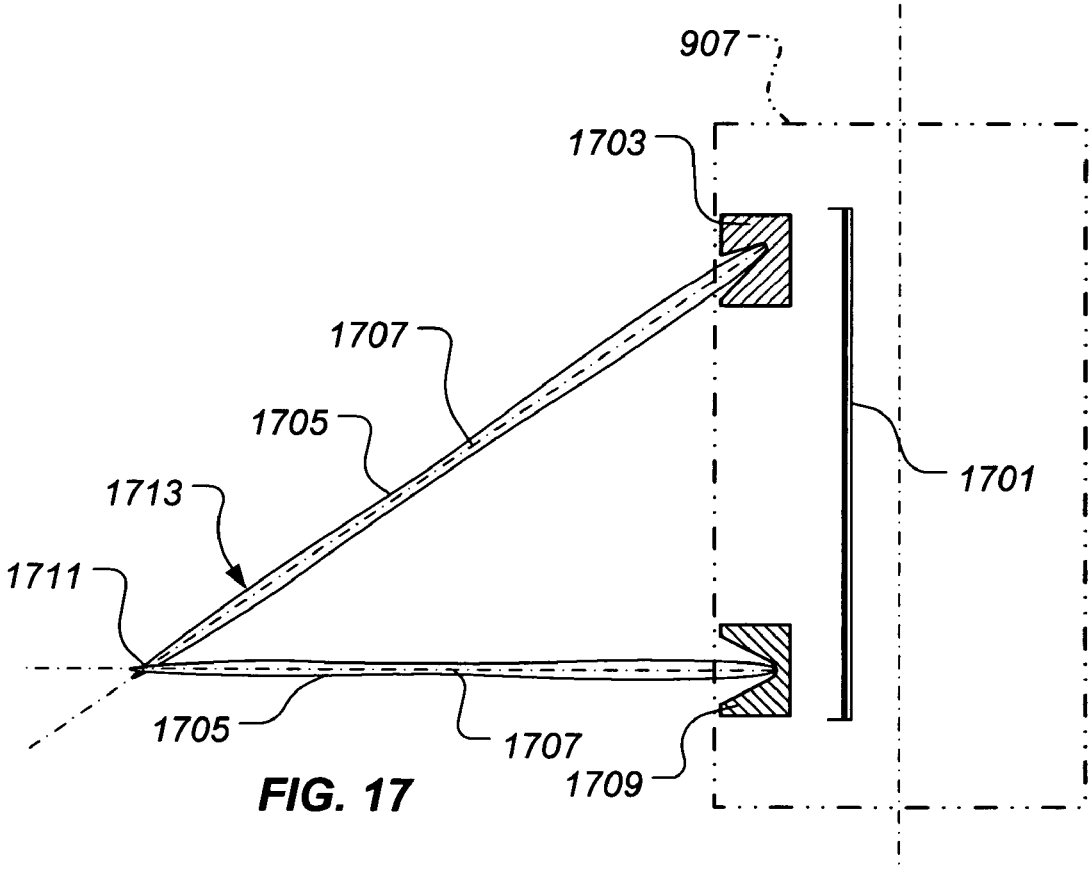
FIG. 17 is a cross-sectional view of an illustrative embodiment of a jet antenna generator according to the present invention.

FIG. 17 depicts another particular embodiment of a jet antenna generator 1701 according to the present invention.

This embodiment generally corresponds to the embodiment of FIGS. 10 and 11, except that jet sources 1703, 1709 generate jets instead of plasmas, as do plasma sources 1003. In one embodiment, jet sources 1703, 1709 generally correspond to the embodiment of plasma source 1005 shown in FIG. 12, except that liner 1207 comprises an electrically conductive material, such as a metal. When explosive charge 1201 is detonated, the ensuing detonation wave collapses liner 1207 into a very high speed jet 1705 projected along axis 1707. Jets 1705 intersect generally at 1711 to form jet antenna 1713.

It should be noted that columnar jet sources and sheet jet sources may be combined to form a jet antenna. For example, jet source 1703 or jet source 1709 may be implemented with jet source 1603 to form a jet antenna. It should also be noted that the scope of the present invention encompasses the modification of any of the plasma antenna generator embodiments disclosed in this Specification to corresponding jet antenna generator embodiments.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A fluid antenna generator, comprising:

a first source of electrically conductive fluid; and a second source of electrically conductive fluid, wherein the first source and the second source are oriented such that, when the first source and the second source are operated, the electrically conductive fluid generated by the first source intersects the electrically conductive fluid generated by the second source.

2. The fluid antenna generator, according to claim 1, wherein the first source is a first plasma source and the second source is a second plasma source.

3. The fluid antenna generator, according to claim 2, wherein at least one of the first plasma source and the second plasma source comprises:

a columnar plasma source.

4. The fluid antenna generator, according to claim 2, wherein at least one of the first plasma source and the second plasma source comprises:

a sheet plasma source.

5. The fluid antenna generator, according to claim 2, wherein at least one of the first plasma source and the second plasma source comprises:

a shaped charge; and an ionizable material operably associated with the shaped charge.

6. The fluid antenna generator, according to claim 5, wherein the shaped charge comprises:

a linear shaped charge.

7. The fluid antenna generator, according to claim 2, wherein at least one of the first plasma source and the second plasma source comprises:

an ionizable material;

an explosive charge adapted to project the ionizable material upon detonation; and a detonator for detonating the explosive charge.

8. The fluid antenna generator, according to claim 7, wherein the ionizable material includes an alkali metal.

9. The fluid antenna generator, according to claim 1, wherein the first source is a first jet source and the second source is a second jet source.

10. The fluid antenna generator, according to claim 9, wherein at least one of the first jet source and the second jet source comprises:

a columnar jet source.

11. The fluid antenna generator, according to claim 9, wherein at least one of the first jet source and the second jet source comprises:

a sheet jet source.

12. The fluid antenna generator, according to claim 9, wherein at least one of the first jet source and the second jet source comprises:

a shaped charge.

13. The fluid antenna generator, according to claim 12, wherein the shaped charge comprises:

a linear shaped charge.

14. The fluid antenna generator, according to claim 9, wherein at least one of the first jet source and the second jet source comprises:

a liner;

an explosive charge adapted to project the liner upon detonation; and a detonator for detonating the explosive charge.

15. The fluid antenna generator, according to claim 14, wherein the liner comprises a metal.

16. A fluid antenna generator, comprising:

a first plurality of sources of electrically conductive fluid, oriented such that the electrically conductive fluid generated by each of the first plurality of sources intersect; and a second plurality of sources of electrically conductive fluid, oriented such that the electrically conductive fluid generated by each of the second plurality of sources intersect and oriented such that the electrically conductive fluid generated by the second plurality of sources intersects the electrically conductive fluid generated by the first plurality of sources.

17. The fluid antenna generator, according to claim 16, wherein each of the first plurality of sources and each of the second plurality of sources comprises a plasma source.

18. The fluid antenna generator, according to claim 16, wherein each of the first plurality of sources and each of the second plurality of sources comprises a jet source.

19. A method for generating a fluid antenna, comprising:

generating a first electrically conductive fluid portion; and generating a second electrically conductive fluid portion, such that the first electrically conductive fluid portion and the second electrically conductive fluid portion intersect.

20. The method, according to claim 19, wherein the first electrically conductive fluid portion and the second electrically conductive fluid portion each comprises:

a plasma.

21. The method, according to claim 19, wherein the first electrically conductive fluid portion and the second electrically conductive fluid portion each comprises:

a jet.

* * * * *